US006460276B1

(12) United States Patent
Ireland et al.

(10) Patent No.: US 6,460,276 B1
(45) Date of Patent: Oct. 8, 2002

(54) EXCAVATION BUCKET INCORPORATING AN IMPACT ACTUATOR ASSEMBLY

(75) Inventors: Odin Ireland, Laval-des-Rapides; Robert Cossette, St-Lambert, both of (CA)

(73) Assignee: 3786111 Canada Inc., Ste-Julie (CA)

( * ) Notice: Subject to any disclaimer, the term of this patent is extended or adjusted under 35 U.S.C. 154(b) by 0 days.

(21) Appl. No.: 09/147,876

(22) PCT Filed: Sep. 18, 1997

(86) PCT No.: PCT/CA97/00686

§ 371 (c)(1),
(2), (4) Date: Mar. 18, 1999

(87) PCT Pub. No.: WO98/12389

PCT Pub. Date: Mar. 26, 1998

Related U.S. Application Data

(60) Provisional application No. 60/026,274, filed on Sep. 18, 1996.

(51) Int. Cl.[7] ..... E02F 3/36

(52) U.S. Cl. ..... 37/447; 37/444

(58) Field of Search ..... 37/446, 403, 447, 37/444, 466, 906, 904; 173/200, 206

(56) References Cited

U.S. PATENT DOCUMENTS 3,113,390 A * 12/1963 Pewthers ..... 37/447
3,512,284 A * 5/1970 Haynes ..... 37/447
3,520,076 A * 7/1970 Nichols ..... 37/446
3,645,021 A * 2/1972 Sonerud ..... 37/904
3,659,730 A * 5/1972 Butler ..... 214/146 E
4,111,269 A * 9/1978 Ottestad ..... 173/134
4,132,017 A * 1/1979 Robson et al. ..... 37/447
4,625,438 A * 12/1986 Mozer ..... 37/447
4,892,359 A * 1/1990 Ottestad ..... 37/447
4,959,915 A * 10/1990 Roussin et al. ..... 37/904
5,065,326 A * 11/1991 Sahm ..... 37/DIG. 1
5,065,824 A * 11/1991 Ottestad ..... 173/134
5,269,382 A * 12/1993 Ottestad ..... 173/200
5,353,532 A * 10/1994 Lysenko et al. ..... 37/447
5,408,768 A * 4/1995 Karani ..... 37/466
5,678,332 A * 10/1997 Hawkins ..... 37/403
5,727,639 A * 3/1998 Jeter ..... 173/132
6,032,093 A * 2/2000 Denbraber et al. ..... 37/348

* cited by examiner

*Primary Examiner*—Thomas B. Will
*Assistant Examiner*—Kristine Markovich
(74) *Attorney, Agent, or Firm*—Eric Fincham

(57) ABSTRACT

An excavation bucket incorporating an impact actuator assembly including a bucket body, a movable floor portion and an impact actuator provided between and mounted to the bucket body and the movable floor portion is described herein. The movable floor portion is longitudinally movable in the bucket body. When activated, the impact actuator assembly generates longitudinal impacts onto the movable floor portion to cause the repetitive longitudinal movements of the floor portion with respect to the bucket body. A forward edge of the floor portion is provided with tools such as teeth to penetrate hard soils.

21 Claims, 14 Drawing Sheets

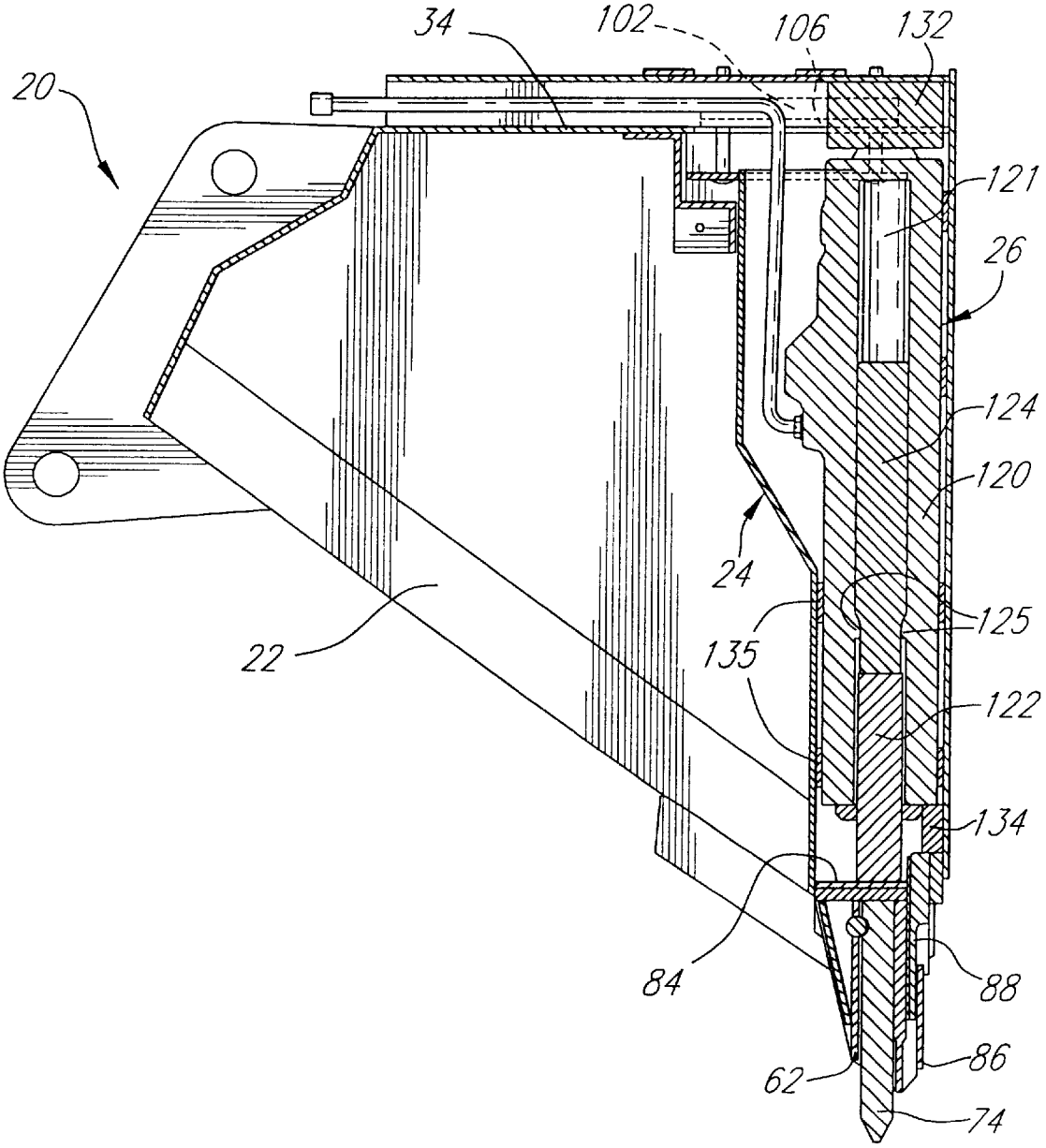
FIG. 4
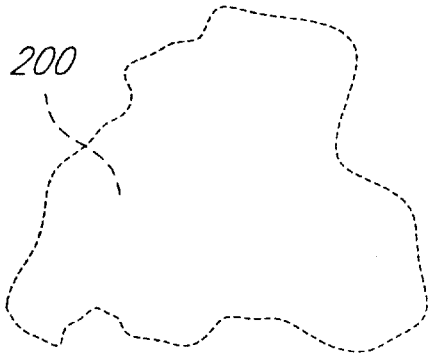

EXCAVATION BUCKET INCORPORATING AN IMPACT ACTUATOR ASSEMBLY

This application claims the benefit of U.S. Provisional Application No. 60/026,274, filed Sep. 18, 1996.

FIELD OF THE INVENTION

The present invention relates to excavation buckets. More particularly, the present invention is concerned with excavation buckets incorporating an impact actuator assembly.

BACKGROUND OF THE INVENTION

The prior art is replete with configurations of excavating buckets designed to better dig into hard soils.

For example, U.S. Pat. No. 4,625,438 entitled: "Excavating bucket having power driven, individually controlled digging teeth" issued on Dec. 2nd, 1986 to Daniel S. Mozer describes an excavating bucket having a leading edge provided with a row of individually pneumatically driven digging teeth. Each digging tooth is connected to a pneumatic impact hammer that reciprocates the tooth at high speed and with great force.

The excavating bucket described by Mozer has several drawbacks. For example, since pneumatic impact hammers are used the earth working machine to which the excavating bucket is mounted must be provided with an air compressor and adequate supplemental conduits between the air compressor and the bucket. Also, since each tooth is connected to an individual pneumatic impact hammer, the total weight of the excavating bucket is much higher than the weight of a conventional bucket, which is a disadvantage when the arm of the earthmoving machine is fully extended, since conventional earth moving machines are designed to move weights similar to the weight of conventional buckets. Yet another drawback of the excavating bucket of Mozer is that each moving tooth requires a certain amount of clearance to be reciprocately moved and that dirt and water may enter the hollow casing enclosing the pneumatic hammers by each of the tooth to body clearances.

OBJECTS OF THE INVENTION

An object of the present invention is therefore to provide an improved excavating bucket incorporating an impact actuator.

Another object of the invention is to provide an excavating bucket incorporating an impact actuator free of the above mentioned drawbacks of the prior art.

SUMMARY OF THE INVENTION

More specifically, in accordance with the present invention, there is provided an excavation bucket comprising:

- a bucket body including a floor portion having a longitudinal axis and lateral side portions;
- a movable floor so mounted to the bucket body as to (a) be longitudinally slidable between a retracted position and an extended position, and (b) provide a free space between the floor portion and the movable floor;
- means for selectively slide the movable floor between the retracted and extended positions; the sliding means being mounted in the free space.

Other objects, advantages and features of the present invention will become more apparent upon reading of the following non restrictive description of preferred embodiments thereof, given by way of example only with reference to the accompanying drawings.

BRIEF DESCRIPTION OF THE DRAWINGS

In the appended drawings:

FIG. 4 is a side sectional view illustrating the excavating bucket of FIG. 1 before a contact with a rock;

DESCRIPTION OF THE PREFERRED EMBODIMENT

Figure 1:
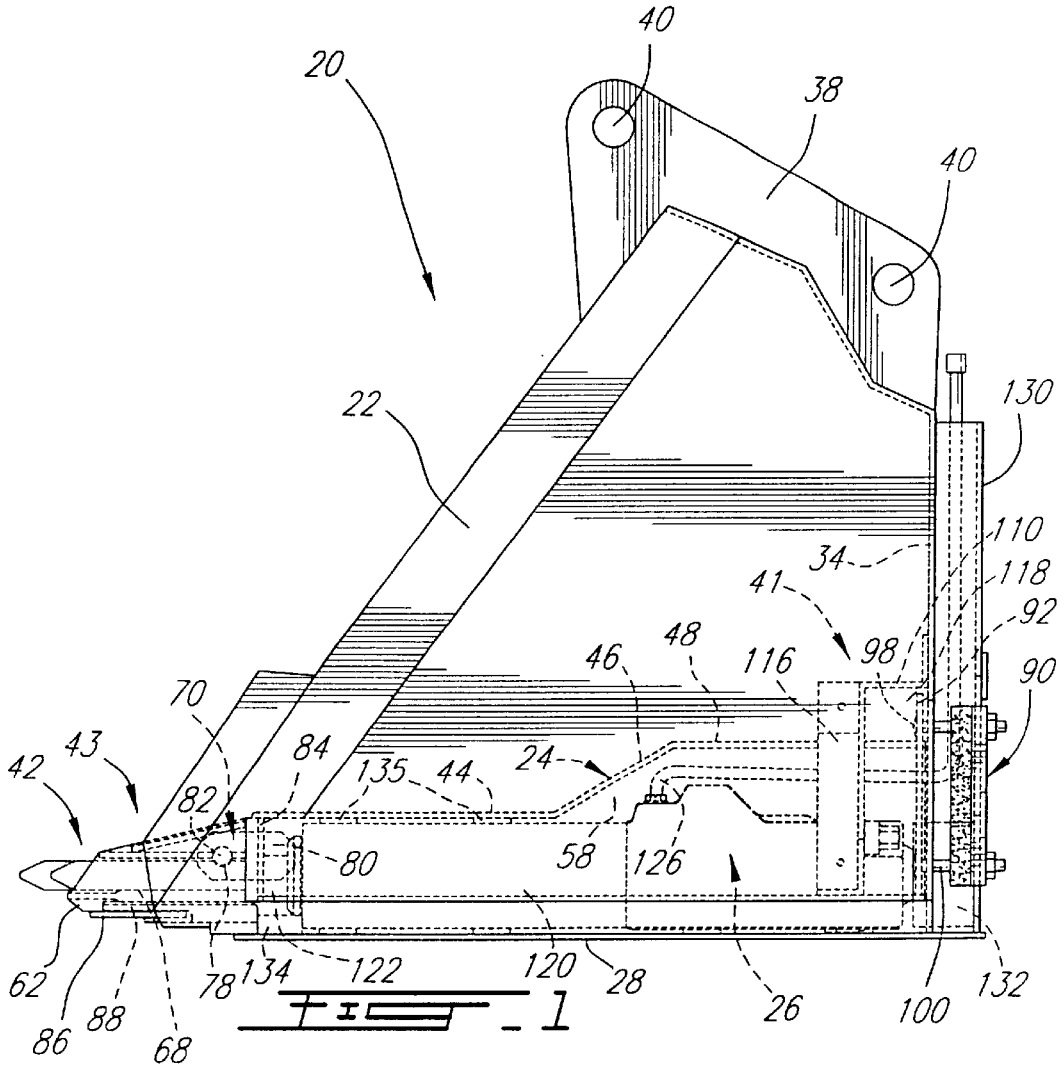
FIG. 1 is a side elevational view illustrating an excavating bucket according to an embodiment of the present invention.
Figure 2:
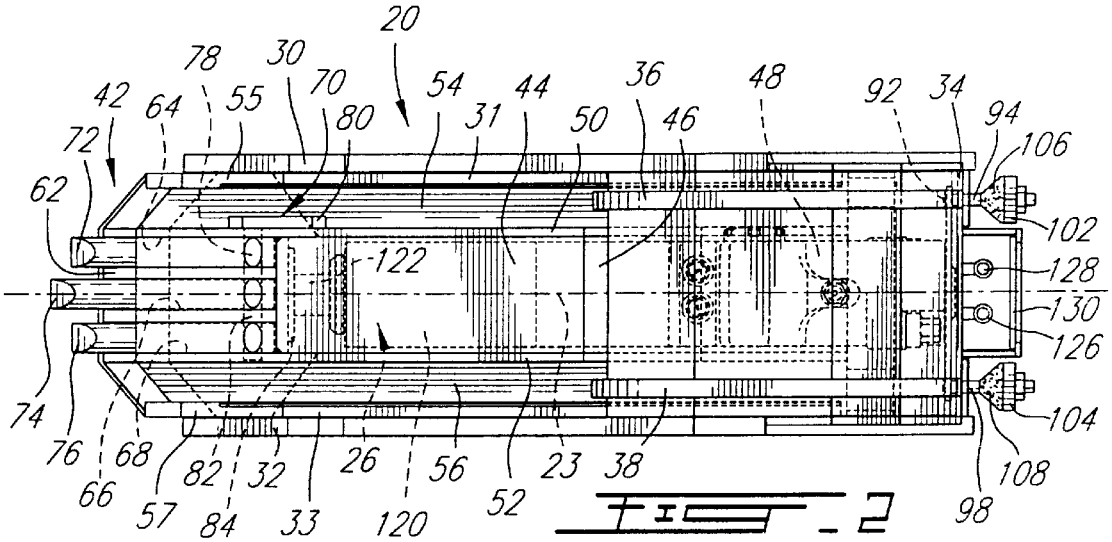
FIG. 2 is a top plan view of the excavating bucket of FIG. 1.
Figure 3:
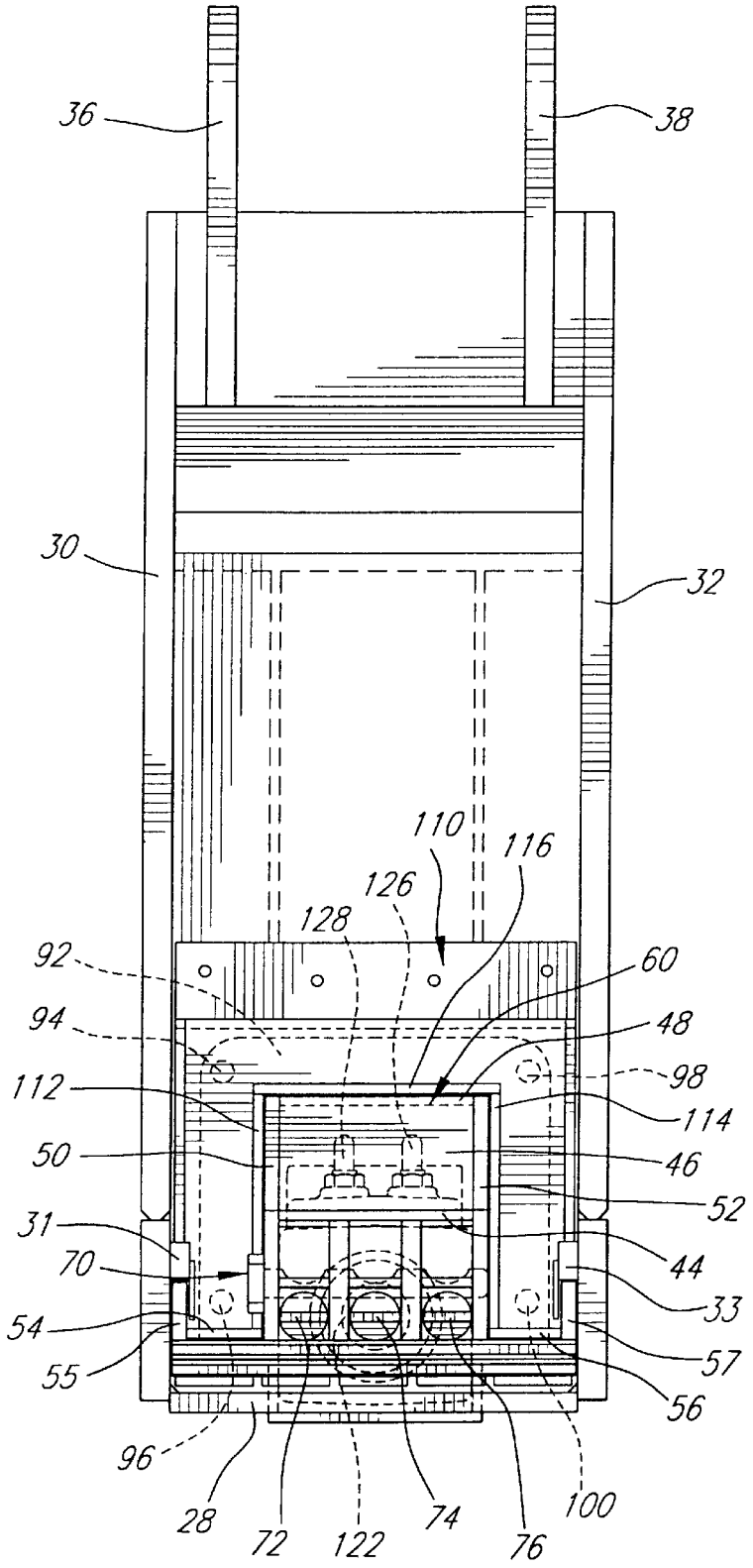
FIG. 3 is an enlarged front elevational view of the excavating bucket of FIG. 1.

Referring to FIGS. 1 to 3 of the appended drawings, an excavation bucket 20 according to a preferred embodiment of the present invention will be described. The excavation bucket 20 generally includes a bucket body 22, a longitudinally movable floor 24 and an impact actuator assembly 26.

The bucket body 22 has a longitudinal axis 23 and includes a floor 28, a pair of lateral sides 30, 32, a rear wall 34, and a pair of mounting elements 36, 38 each provided with apertures 40 to which the end of the arm of a conventional earth moving machine (not shown) may be secured. Each lateral side 30 and 32 is provided with a floor guide 31 and 33, respectively, to prevent unwanted displacement of the movable floor 24 as will be described hereinafter.

The movable floor 24 includes a proximate end 41 and a distal end 43. The distal end 43 is provided with a leading edge portion 42. The movable floor 24 also includes a first flat portion 44, an angled portion 46, a second flat portion 48, first and second lateral side walls 50, 52 (see FIG. 3), third and fourth flat portions 54, 56 and a pair of lateral guide abutting elements 55, 57. The movable floor 24 is so mounted to the bucket body 22 as to be reciprocately longitudinally slidable between a retracted position (illustrated in FIG. 1) and an extended position (shown, for example, in FIG. 5). The lateral guide abutting elements 55, 57 are so configured and sized as to be receivable under the floor guides 31, 33, respectively, to allow only longitudinal movements of the movable floor 24.

The configuration and position of the movable floor 24 with respect to the bucket body 22 creates a free space 58 (FIG. 1) between the generally inverted U-shaped portion 60 of the movable floor 24 and the floor 28 of the bucket body 22.

The leading edge portion 42 of the movable floor 24 includes a tool holding assembly 62 provided with three tool receiving apertures 64, 66 and 68 and with a tool locking mechanism 70.

The tool receiving apertures are configured and sized to receive generally cylindrical teeth 72, 74 and 76 each provided with a tangential channel 78. The tool locking mechanism 70 includes a handle 80 and a cylindrical pivot bar 82, fixedly mounted to the handle 80 and provided with a longitudinal channel (not shown). The handle may be pivoted between a non locking position where the teeth 72, 74 and 76 are faced by the longitudinal channel of the pivot bar and a locking position where the cylindrical pivot bar enters the tangential channels 78 of the teeth 72, 74 and 76. The longitudinal channel is so configured and sized that the teeth 72, 74 and 76 may be removed from the tool receiving apertures 64, 66 and 68, respectively, when the longitudinal channel faces the teeth.

The movable floor 24 also includes a replaceable impact receiving plate 84 the purpose of which will be described hereinafter.

The leading edge portion 42 includes a lower projection 86 configured and sized to receive a lower projection 88 of the floor 28 to thereby prevent dirt from entering the free space 58.

The proximate end 41 of the movable floor 24 is secured to the rear wall 34 of the bucket body 22 via a securing assembly 90. It is to be noted that the securing assembly 90 allows the movable floor 24 to reciprocately slide between its retracted and extended positions.

The securing assembly 90 includes an internal strengthening plate 92 fixedly mounted to the proximate end 41 of the movable floor 24 and having a generally inverted U-shape, four fasteners 94, 96, 98 and 100, a pair of external rigid plates 102, 104 each provided with respective resilient layers 106, 108. The strengthening plate 92 is fixedly mounted to the second flat portion 48, to the first and second lateral side walls 50, 52 and to the third and fourth flat portions 54, 56 of the movable wall 24.

The fasteners 94–100 each go through an aperture (not shown) of the internal strengthening plate 92, a corresponding aperture (not shown) of the rear portion 34 of the bucket body 22, and a corresponding aperture (not shown) of one of the external rigid plate 102, 104. It is to be noted that the length of the fasteners 94–100 is greater than the combined thickness of the elements traversed to therefore allow the movable floor 24 to reciprocately slide between its retracted and extended positions.

The rigid plates 102, 104, with their associated layers of resilient material 106, 108 therefore prevent the movable floor 24 to exceed its extended position. Indeed, the length of the fasteners 94–100 is such that the resilient layers 106, 108 contact the rear wall 34 of the bucket body 22 when the movable floor 24 reaches its extended position.

The excavation bucket 20 also includes a protective cover 110 intended to both protect the proximate end of the movable floor 24 including the securing assembly 90 and to prevent dirt from entering the free space 58. The protective cover 110 is fixedly mounted to the rear wall 34 and to the lateral walls 30 and 32 of the bucket body 22 and includes a pair of lateral elements 112, 114 adjacent to the lateral portions 50, 52 of the movable floor 24 and a top covering element 116 adjacent to the second flat portion 48 of the movable floor 24. The close proximity of these elements prevent dirt from entering the free space 58. Furthermore, layers of friction reducing material (not shown) could be provided between the adjacent elements to reduce the distance between these elements while allowing relative movements thereof.

It is to be noted that the protective cover 110 is so configured and sized as to provide a space 118 in which the upper portion of the strengthening plate 92 may move.

The impact actuator assembly 26 includes a cylindrical body 120, a pressurized gas chamber 121, an impact head 122 and a hammer 124 slidably mounted in the cylindrical body (see FIG. 4). The impact head 122 usually rests against the replaceable impact receiving plate 84 and the hammer 124 is usually pushed towards internal abutments 125 by the pressurized gas in the chamber 121 when the impact actuator assembly 26 is in a non operating state.

Friction reducing pads 135 are provided between the cylindrical body 120 and the movable floor 24 to support the floor 24 onto the body 120 without inducing significant friction. For example, Nylon type material could be used to form the pads 135.

The operation of an impact actuator such as the impact actuator assembly 26 is believed well known in the art and will not be described in details herein. It is however to be noted that since the operation of the impact actuator 26 is similar to conventional impact actuators that are conventionally mounted to the arms of earth moving machines, the fluid conduits 126, 128 may advantageously be connected to the fluid conduits (not shown) usually provided on earth moving machines for the selective operation of the impact actuator. Accordingly, the impact actuator assembly 26 is advantageously an hydraulic impact actuator. However, a pneumatic impact actuator (not shown) could also be used provided that adequate air supply are present on the earth moving machine. It is also to be noted that the impact actuator assembly 26 could be replace by other assemblies to forcefully move the movable floor 24 with respect to the bucket body 22, such as, for example, a motor provided with a cam abutting the movable floor 24.

The fluid conduits 126, 128 are enclosed by a rectangular cover 130 preventing contact between the tubes and external obstacles.

The cylindrical body 120 of the impact actuator assembly 26 is fixedly mounted to the bucket body 22 via a first wedging element 132 (better seen in FIG. 4) provided between the cylindrical body and the rear of the bucket body 22 and a second wedging element 134 (better seen in FIG.

4) provided between the cylindrical body 120 and the front of the bucket body 22.

Turning now to FIGS. 4–11 of the appended drawings, the operation of the excavating bucket 20 of the present invention will be described. Each of these figures illustrates a general step in the breakage of a rock 200 and in the lifting of a portion of this rock from the ground.

In these figures, the portions of the excavating bucket 20 shown in dashed lines illustrate the initial position of these portions at the beginning of the particular step while these same portions are illustrated in full lines to illustrate their final position at the end of the step. Of course, for clarity purposes, not all the moving portions have been illustrated both in dashed and full lines. It is however believed within the reach of one skilled in the art to determine the initial and final positions of all moving portions of the excavating bucket 20.

FIG. 4 of the appended drawings illustrates the excavating bucket 20 in its initial position before the teeth 72, 74 and 76 (only one shown) mounted to the tool holding assembly 62 contact the rock 200. The movable floor 24 is thus in its extended position since the impact actuator 26 it is in a non operating state as described hereinabove. The resilient layers 106, 108 (only one shown) therefore contact the rear wall 34 of the bucket body 22. The hammer 124 is positioned anywhere in the longitudinal actuator body 120, and the impact head 122 rests against the replaceable impact receiving plate 84.

Figure 5:
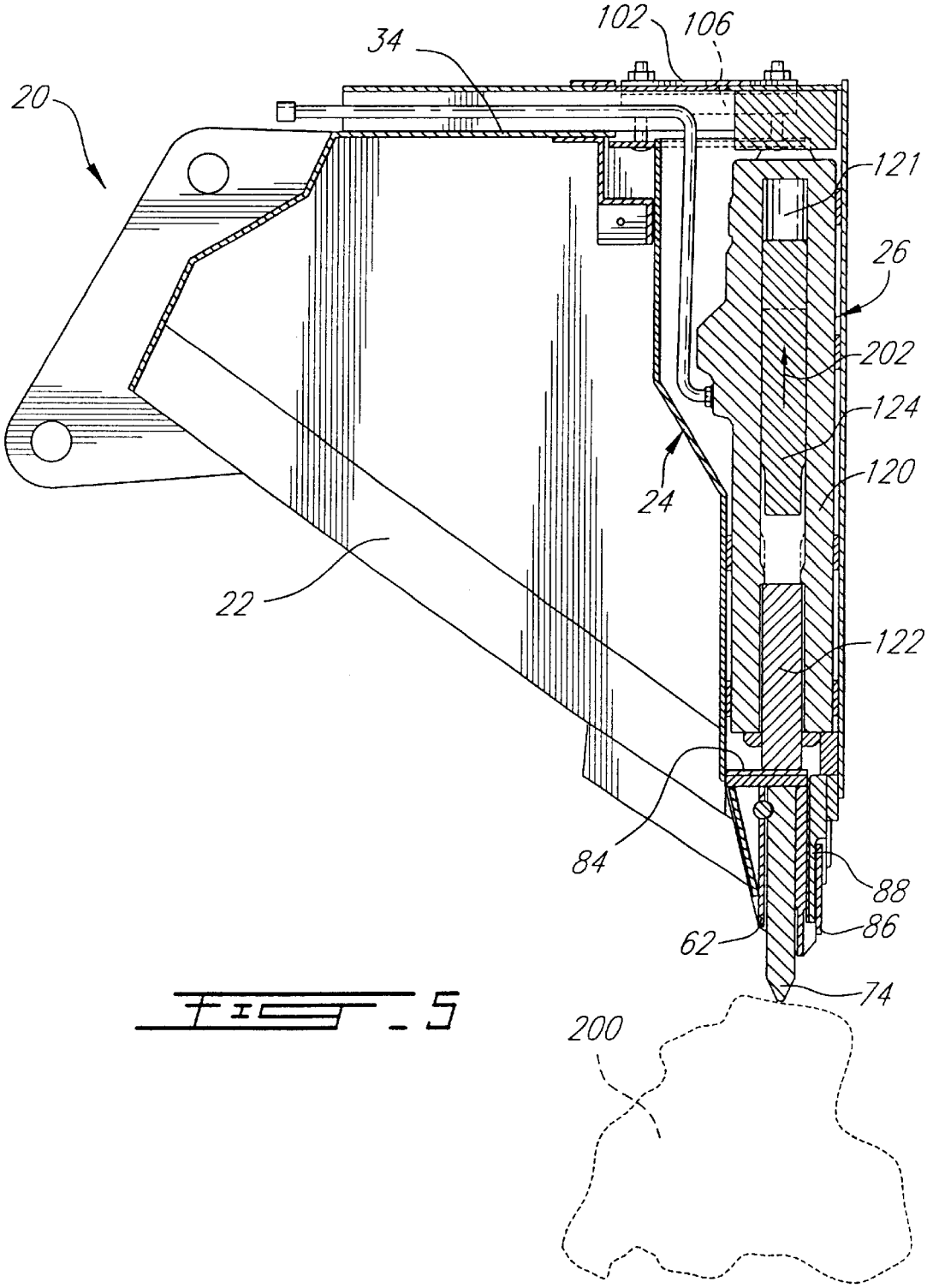
FIG. 5 is a side sectional view illustrating the excavating bucket of FIG. 1 after a contact with a rock and before a first impact of the impact actuator.

Turning now to FIG. 5, the teeth 72, 74 and 76 (only one shown) mounted to the tool holding assembly 62 of the excavating bucket 20 contact the rock 200. The movable floor 24 is in its retracted position since the arm (not shown) of the earth moving machine pushes the excavation bucket 20 downwardly and since the rock 200 prevent further forward movements of the excavation bucket 20. The resilient layers 106, 108 (only one shown) do not contact the rear wall 34 of the bucket body 22 when the movable floor is in the retracted position. The hammer 124 is moved rearwardly in the longitudinal actuator body 120 (see arrow 202) in preparation for a first impact by the energization of the impact actuator assembly 26 by the operator, and the impact head 122 rests against the replaceable impact receiving plate 84.

Figure 6:
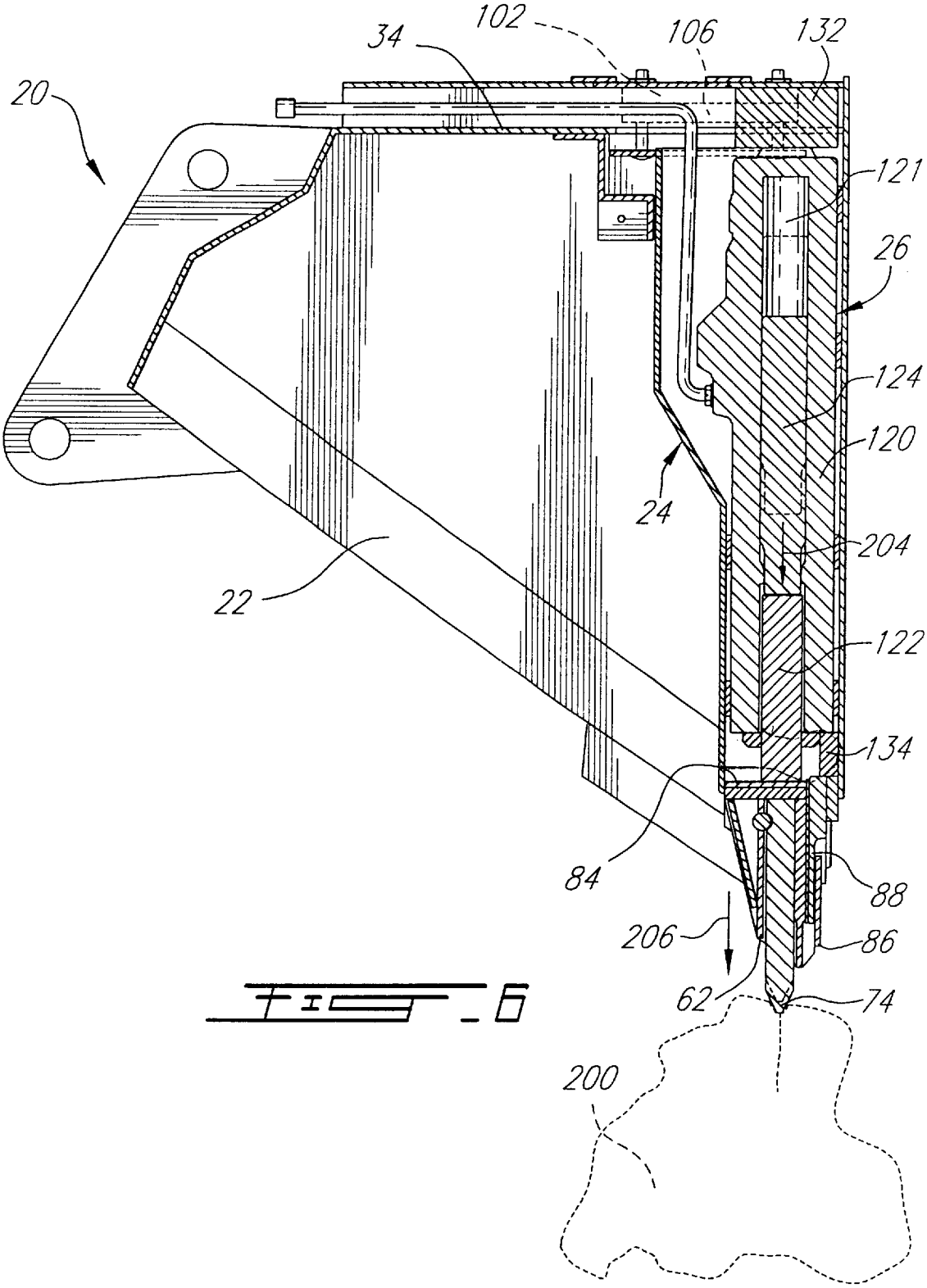
FIG. 6 is a side sectional view illustrating the excavating bucket of FIG. 1 during a first impact of the impact actuator.

FIG. 6 of the appended drawings illustrates a first impact of the impact actuator assembly 26. During this impact, the hammer 124 is forcefully moved forwardly in the longitudinal actuator body 120 (see arrow 204) by the energization of the impact actuator assembly 26 by the operator. The hammer 124 therefore forcefully strikes the impact head 122 that, in turn, forcefully pushes against the replaceable impact receiving plate 84. Since the impact actuator assembly 26 is fixedly mounted to the bucket body 22, the impact of the hammer 124 onto the impact head 122 will cause the movable floor to forcefully move forward (see arrow 206) to reach a partially extended position. A portion of the energy of the hammer 124 will therefore be transferred to the rock 200 in an attempt to break it.

Figure 7:
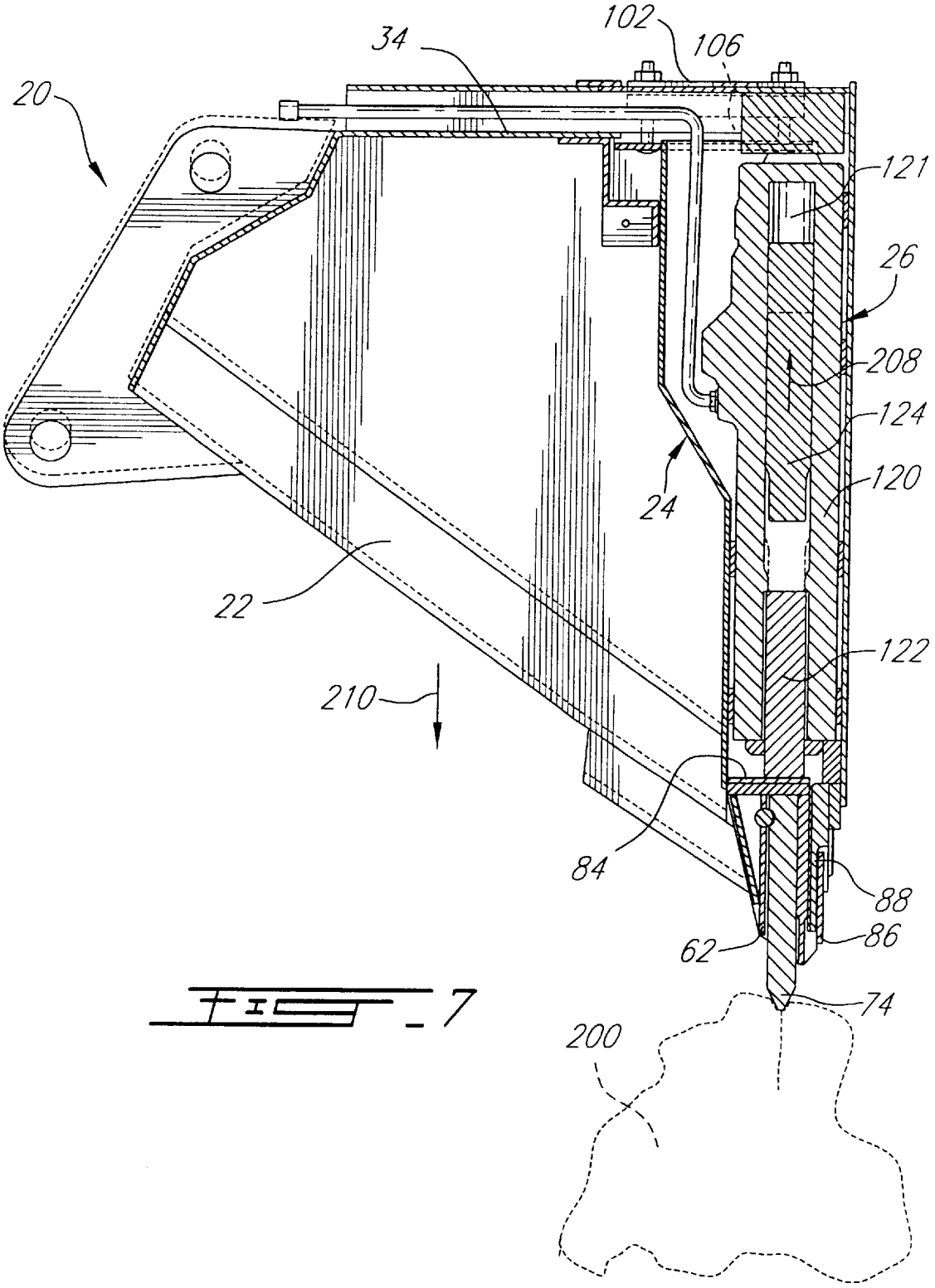
FIG. 7 is a side sectional view illustrating the excavating bucket of FIG. 1 after a first impact and before a second impact of the impact actuator.

FIG. 7 illustrates the impact actuator assembly 26 in its preparation for a second impact of the hammer 124 onto the impact head 122. The hammer 124 is therefore moved rearwardly (see arrow 208). Since the arm (not shown) of the earth moving machine continually pushes downwardly in a scooping operation, the bucket body 22 will be pushed forwardly (see arrow 210) until the moving floor 24 is returned to its retracted position. FIG. 7 is therefore very similar to FIG. 5 but with the teeth 72, 74 and 76 slightly penetrating the rock 200.

It is to be noted that, depending on the hardness of the rock 200, it may take many impacts of the hammer 124 onto the impact head 122 before the rock 200 is fractured as shown in FIG. 7.

Figure 8:
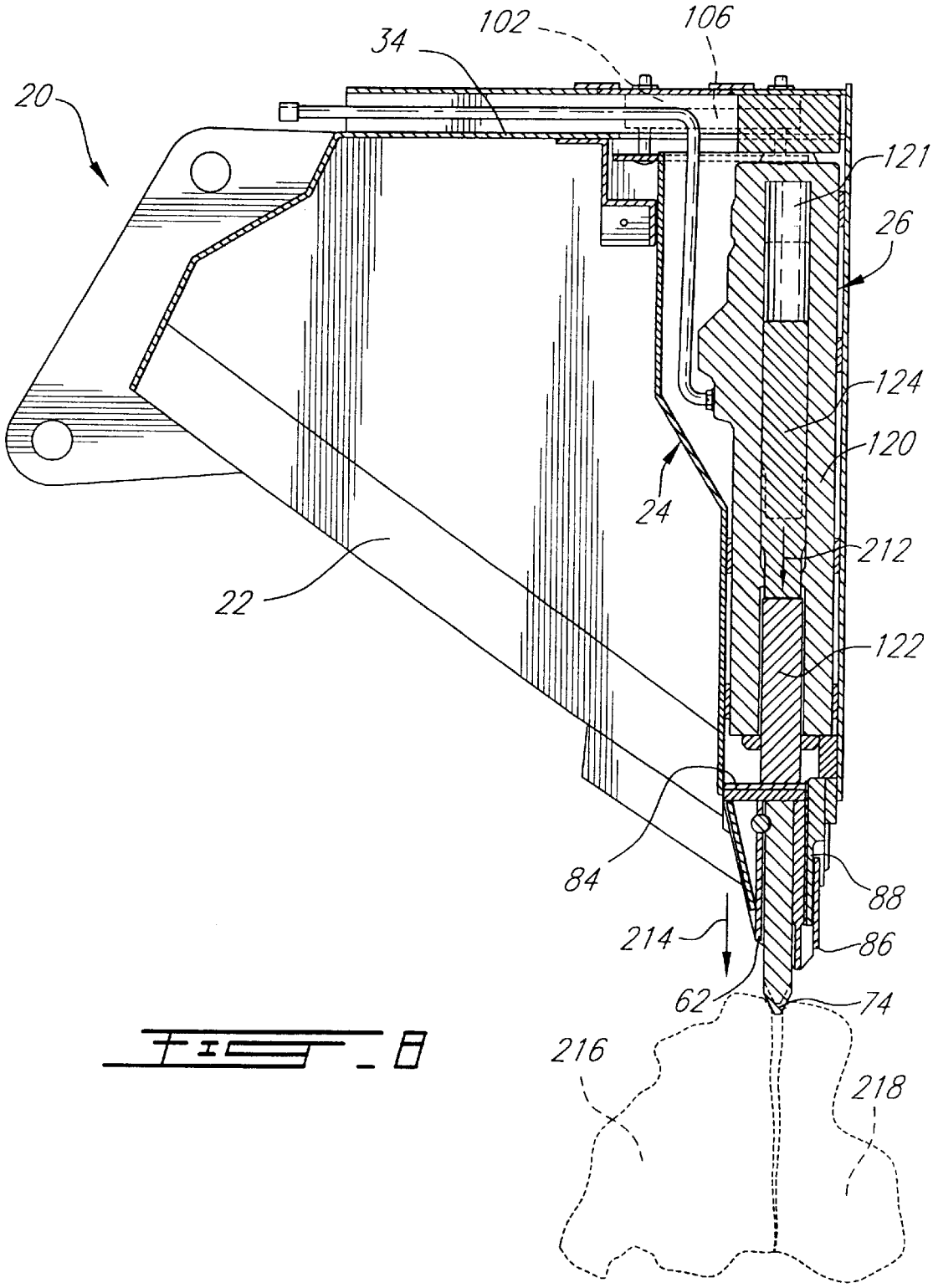
FIG. 8 is a side sectional view illustrating the excavating bucket of FIG. 1 during a second impact of the impact actuator.

FIG. 8 illustrates a second impact of the hammer 124 onto the impact head 122. As before, the hammer 124 is forcefully moved forwardly (see arrow 212) to ultimately cause the forward movement of the movable floor 24 (see arrow 214). This figure also illustrates the rock 200 separated in two portions 216 and 218. It is however to be noted that it is unlikely that a rock 200 would break with only two impacts. It is also to be noted that conventional impact actuator assemblies usually have a frequency of impacts of about 15 impacts every second.

Figure 9:
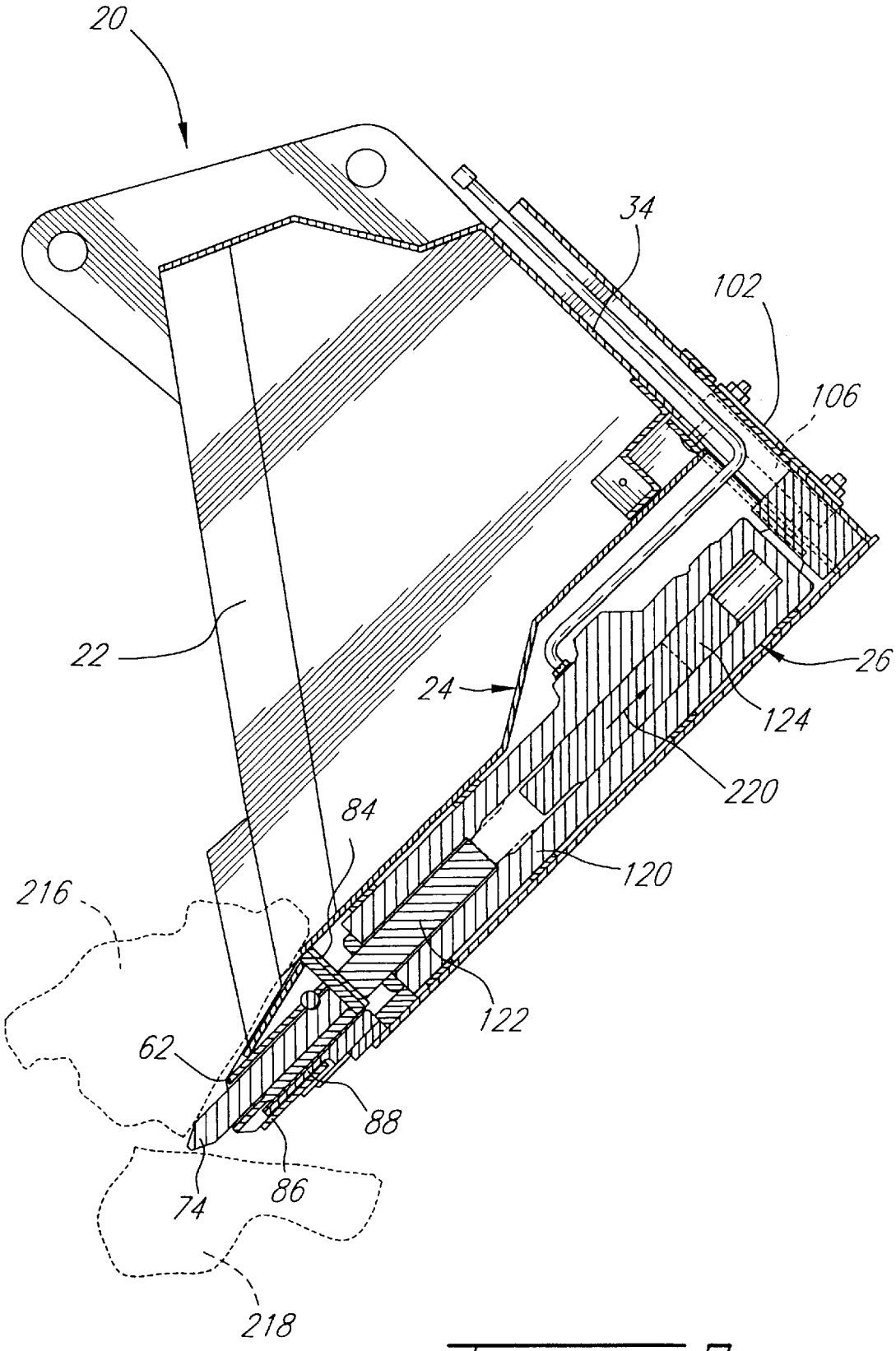
FIG. 9 is a side sectional view illustrating the excavating bucket of FIG. 1 after a second impact and before a third impact of the impact actuator.

FIG. 9 illustrates the portion 216 of the rock 200 being scooped by the bucket body 22.

To illustrate what can happen when the operator keeps the impact actuator assembly 26 energized when it is not required, FIG. 9 also shows the rearward movement of the hammer 124 (see arrow 220) in preparation for a third impact onto the impact head 122. It is to be noted that this impact is not required since the rock 200 is already broken in two.

Figure 10:
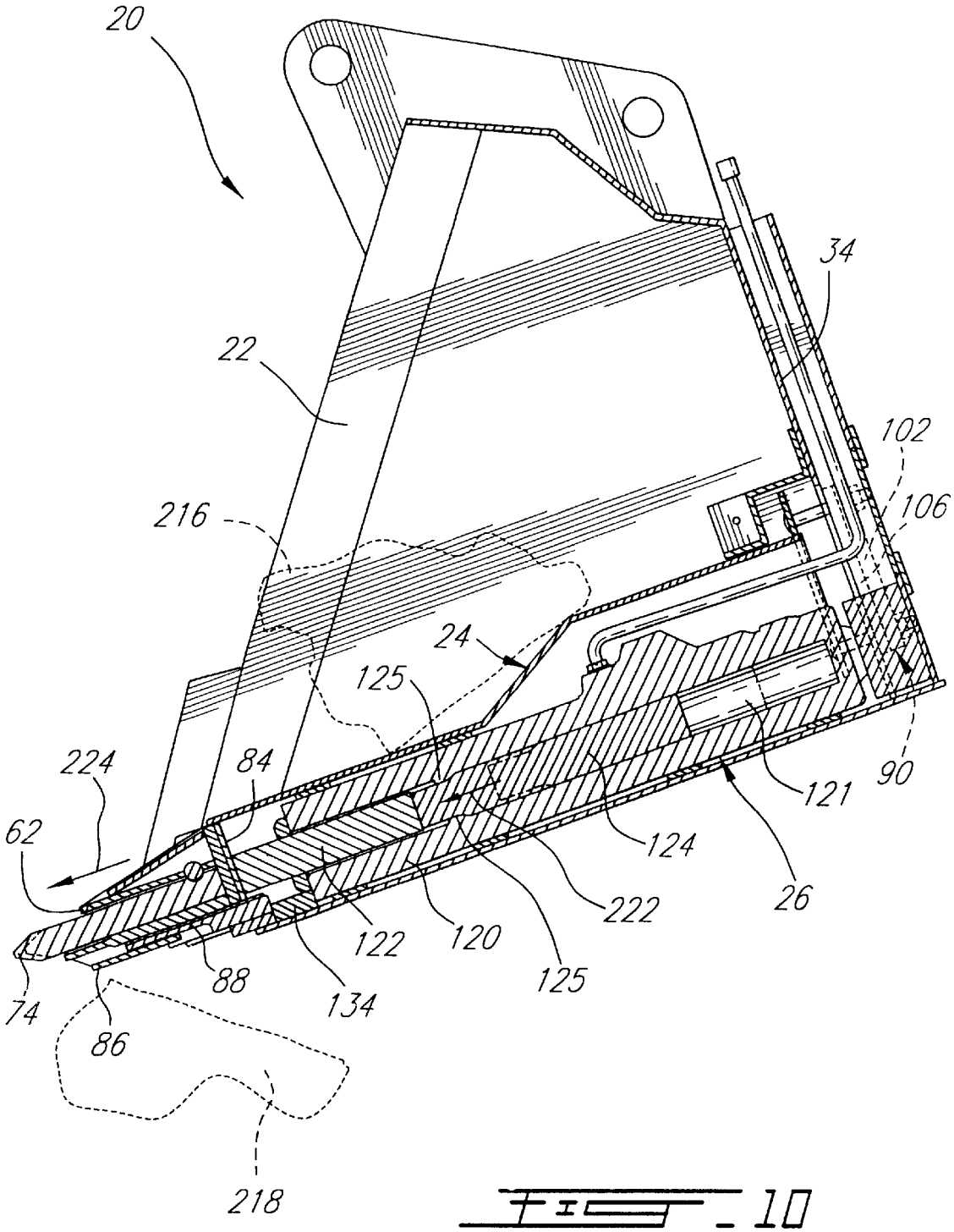
FIG. 10 is a side sectional view illustrating the excavating bucket of FIG. 1 during a third impact of the impact actuator.

FIG. 10 illustrates the unnecessary impact between the hammer 124 and the impact head 122. Since the teeth 72 ,74 and 76 (only one shown) do not contact a hard surface, the movable floor 24 is forcefully moved from its retracted position to its extended position. The securing assembly 90 prevents the disconnection of the movable floor 24 from the bucket body 22. Indeed, the resilient layers 106, 108 are compressed between the external rigid plates 102, 104 and the rear wall 34 of the bucket body 22 to thereby prevent significant further forward movements of the movable floor 24. The resilient layers 106 and 108 therefore reduce the wear of the excavating bucket 20 by damping the impacts of the hammer 124 when the movable floor 24 is fully extended. It is to be noted that, under the force of the impact between the hammer 124 and the impact head 122, the impact head 122 may continue to move forwardly (not shown in FIG. 10) even though the hammer 124 rests against the abutments 125.

Figure 11:
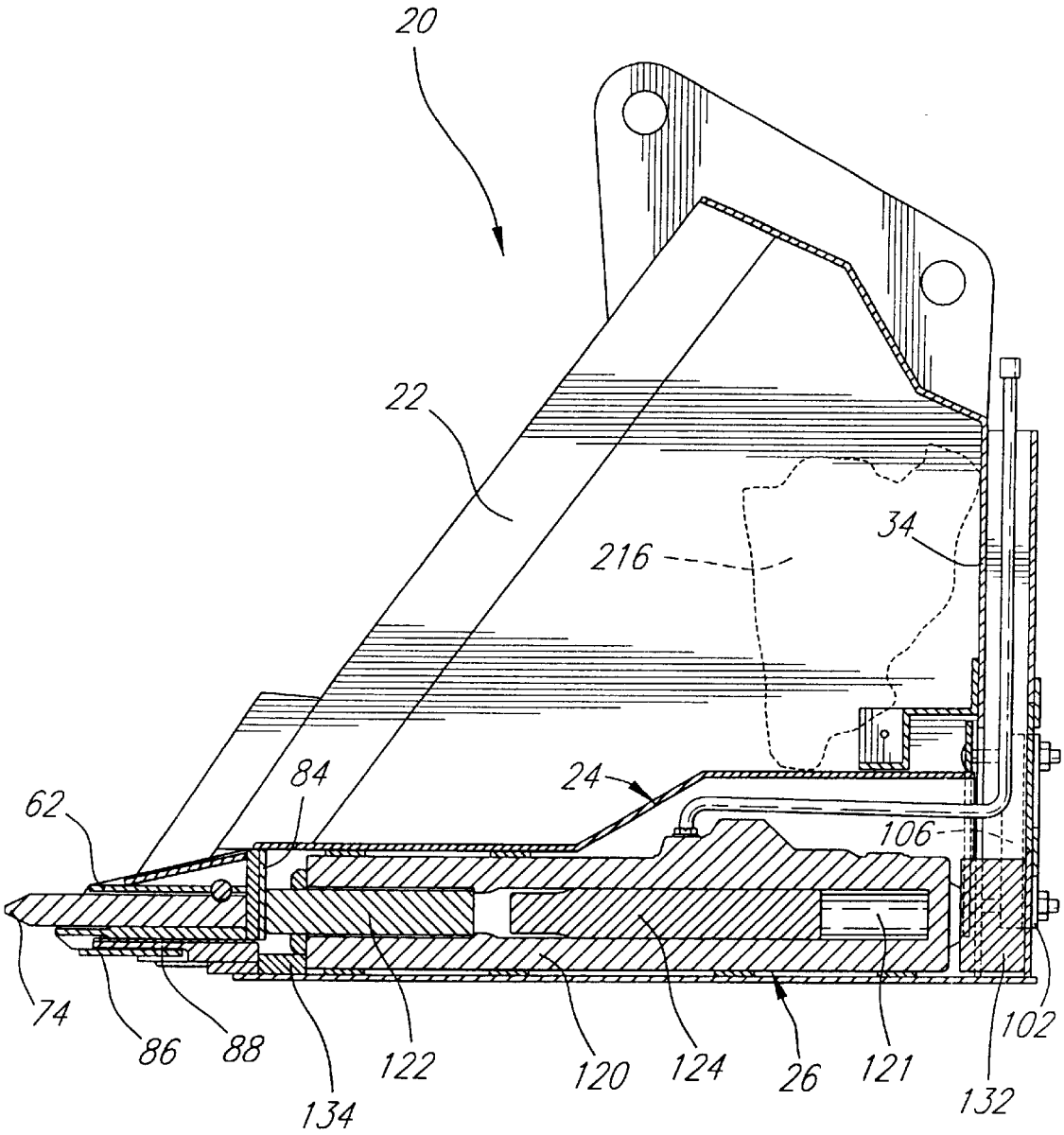
FIG. 11 is a side sectional view illustrating the excavating bucket of FIG. 1 after a portion of a rock has been scooped.

Finally, FIG. 11 illustrates the final position of the excavating bucket 20 having scooped the portion 216 of the rock 200. The movable floor 24 is returned to its retracted position by the movements (not shown) of the bucket body 22 required to scoop the rock 216.

It is to be noted that, as will be easily understood by one skilled in the art, the movements of the hammer 124 into the actuator body 120 are not independently controlled by the operator of the earth moving machine. Indeed, the impact actuator assembly 26, when energized, takes control of the movements of the hammer 124. Therefore, the operator simply has to decide when the impact actuator assembly 26 should be used to more easily scoop the intended material.

Figure 12:
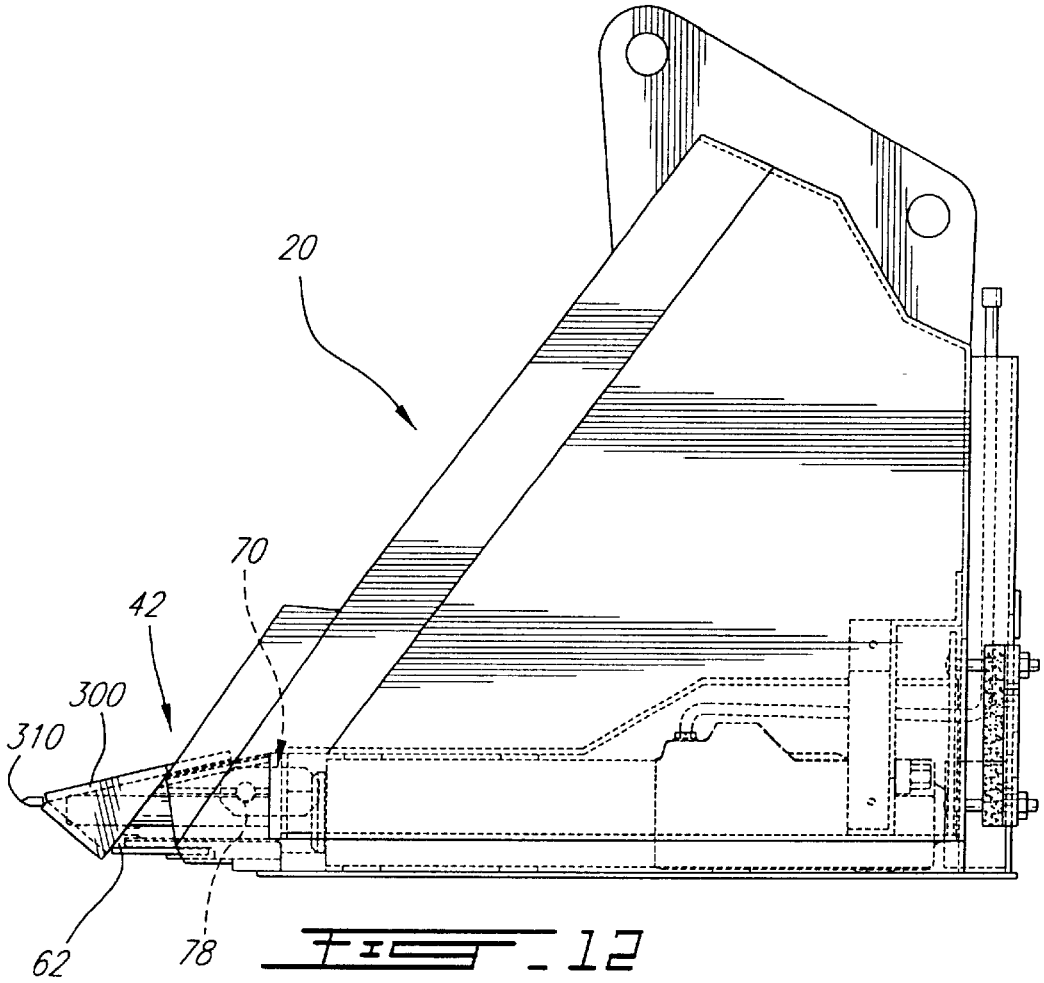
FIG. 12 is a side elevational view of the excavating bucket of FIG. 1 provided with a clay cutting attachment.
Figure 13:
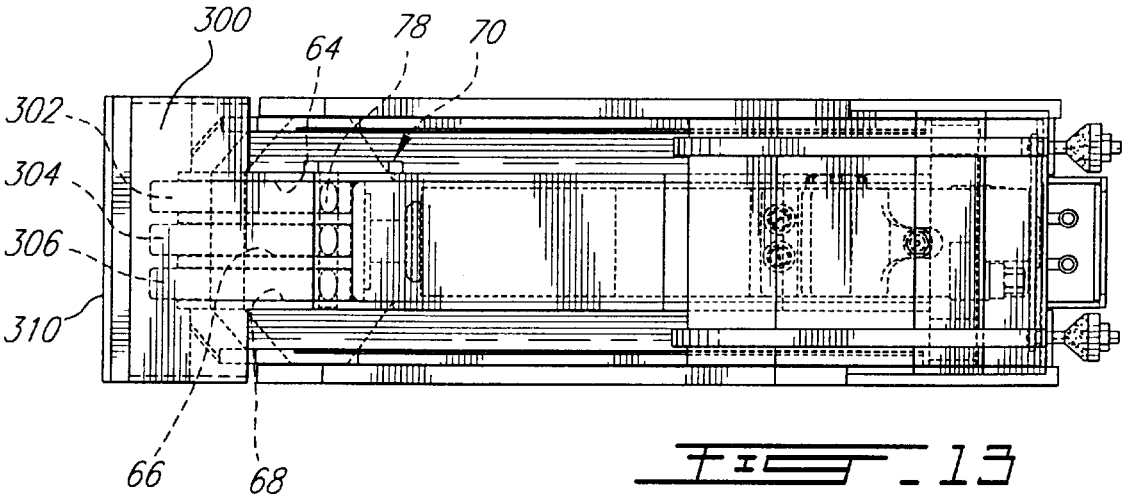
FIG. 13 is a top plan view of the excavating bucket of FIG. 11.

FIGS. 12 and 13 of the appended drawings illustrate the excavation bucket 20 to which a clay cutting attachment 300 has been fitted. The clay cutting attachment 300 includes three mounting rods 302, 304 and 306 configured sized and positioned to enter the three tool receiving apertures 64, 66 and 68 of the tool holding assembly 62. Each mounting rod is provided with a tangential channel 78 enabling the rods to be locked in position by the tool locking mechanism 70 as described hereinabove with respect to the teeth 72, 74 and 76. The edge 310 of the clay cutting attachment 300 is sufficiently sharp to easily cut through clay.

Figure 14:
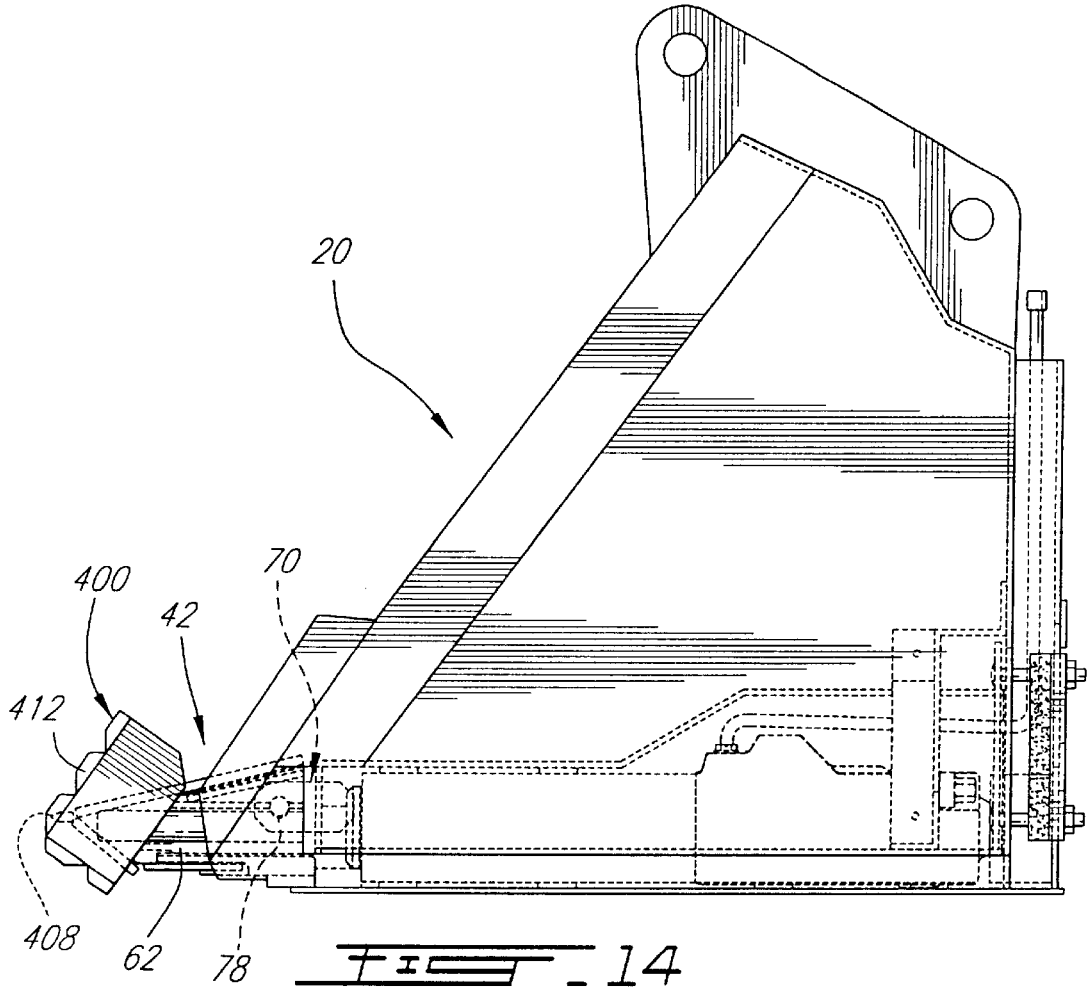
FIG. 14 is a side elevational view of the excavating bucket of FIG. 1 provided with a root shredding attachment
Figure 15:
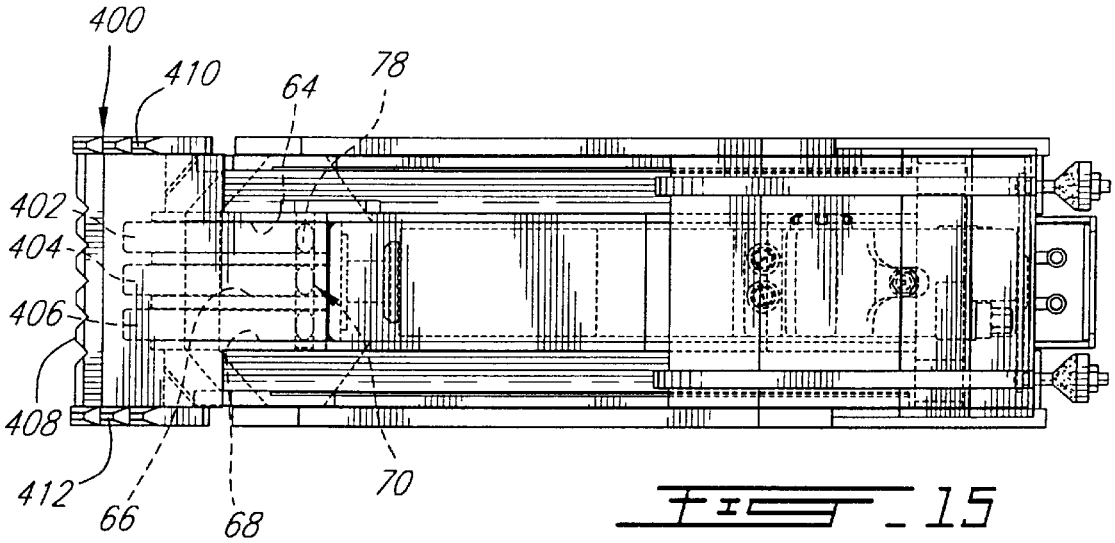
FIG. 15 is a top plan view of the excavating bucket of FIG. 14.

Turning now to FIGS. 14 and 15, a root shredding attachment 400 will be described. The root shredding attachment 400 includes three mounting rods 402, 404 and 406 configured sized and positioned to enter the three tool receiving apertures 64, 66 and 68 of the tool holding assembly 62. Again, each mounting rod is provided with a tangential channel 78 enabling the rods to be locked in position by the tool locking mechanism 70. The root shredding attachment 400 includes a serrated central blade 408 and a pair of lateral serrated blades 410, 412.

Figure 16:
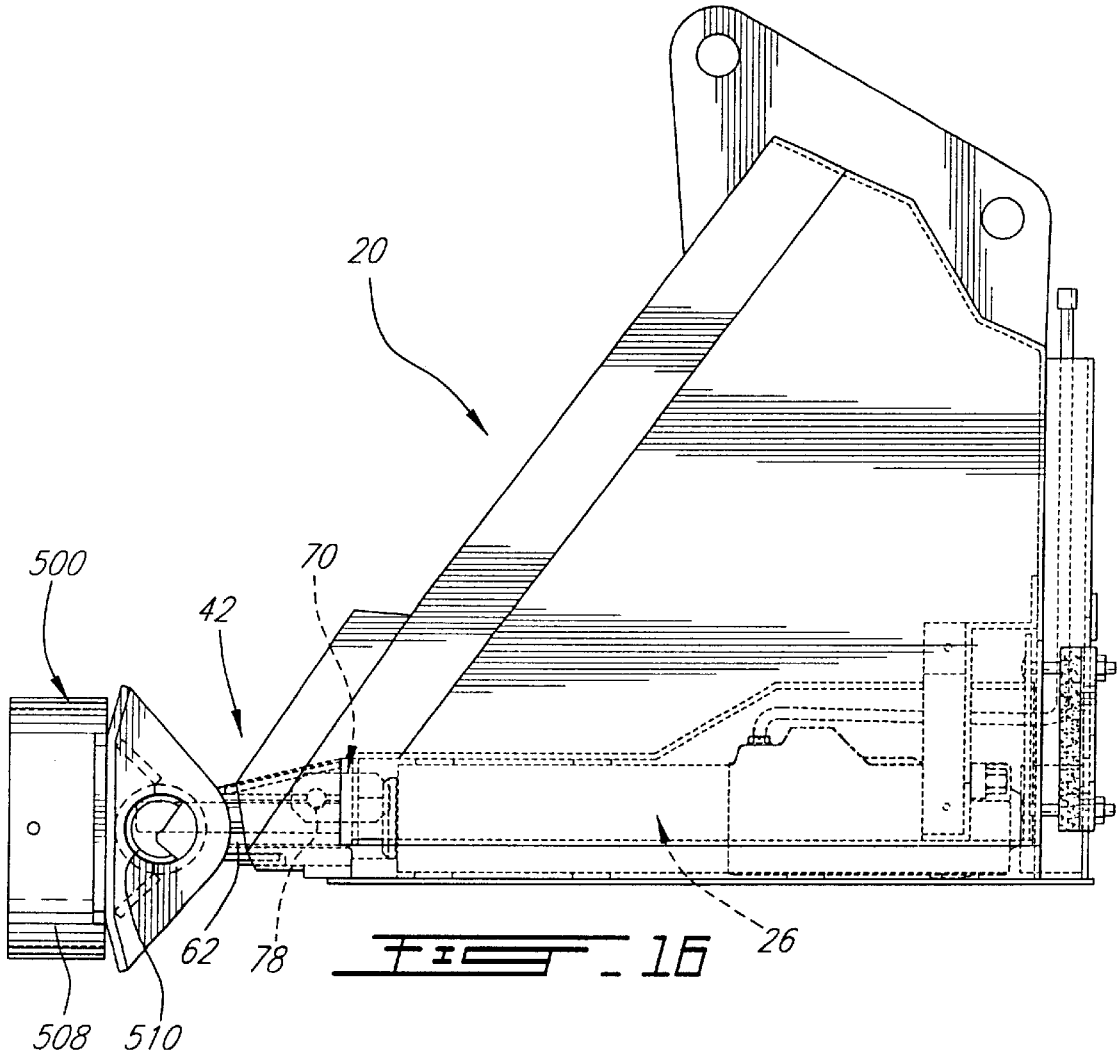
FIG. 16 is a side elevational view of the excavating bucket of FIG. 1 provided with a picket ramming attachment.
Figure 17:
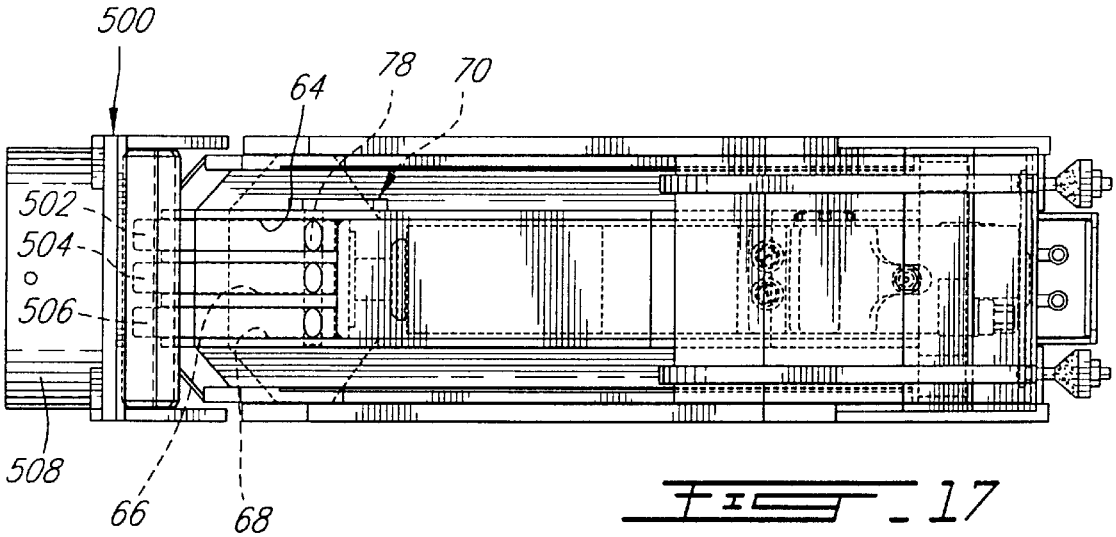
FIG. 17 is a top plan view of the excavating bucket of FIG. 16.

FIGS. 16 and 17 illustrate a picket ramming attachment 500 including three mounting rods 502, 504 and 506 configured sized and positioned to enter the three tool receiving apertures 64, 66 and 68 of the tool holding assembly 62. Again, each mounting rod is provided with a tangential channel 78 enabling the rods to be locked in position by the tool locking mechanism 70. The picket ramming attachment 500 includes a cylindrical picket holder 508 that may be pivoted about a pivot attachment 510. A picket to be rammed (not shown) is inserted in the picket holder 508 and the impact actuator assembly 26 is energized to help ramming the picket in the ground.

Figure 18:
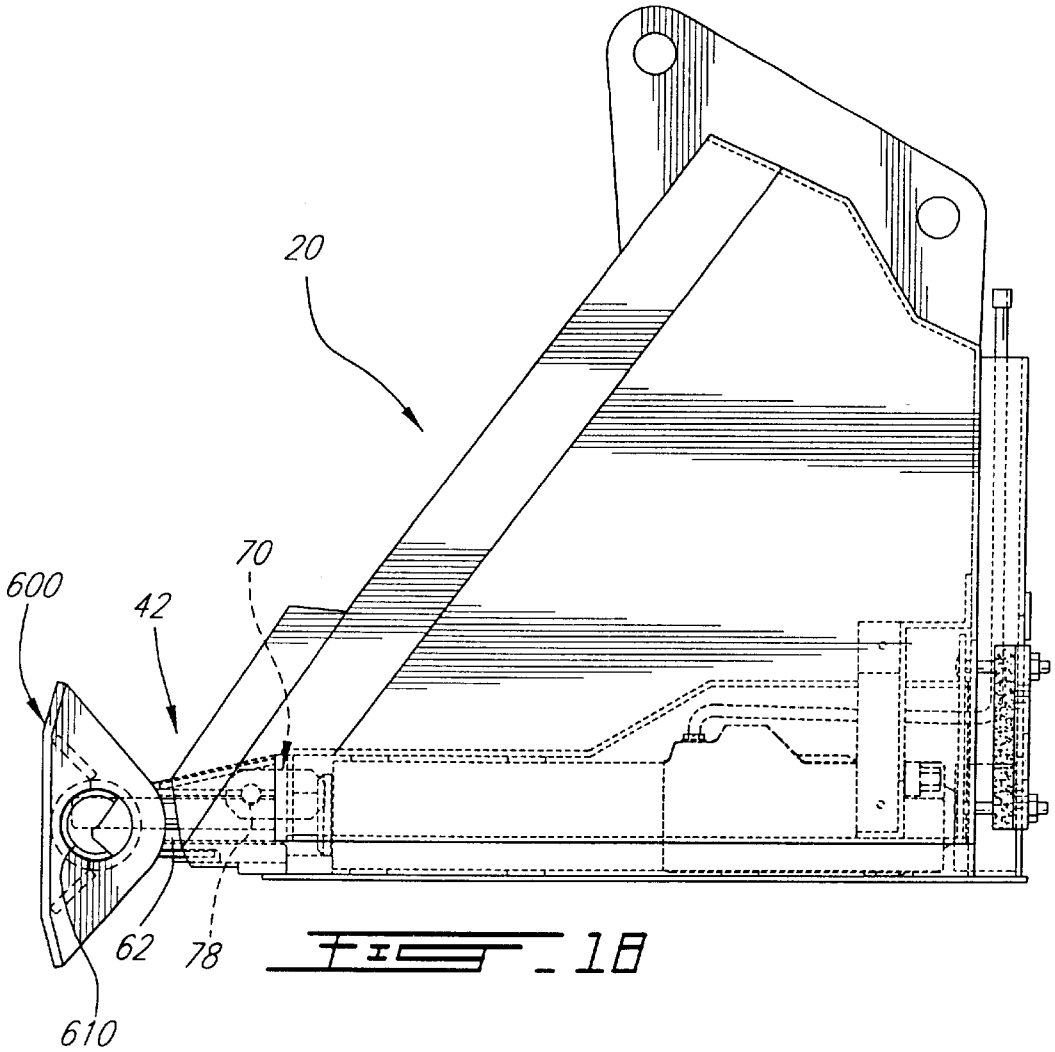
FIG. 18 is a side elevational view of the excavating bucket of FIG. 1 provided with a compaction attachment.
Figure 19:
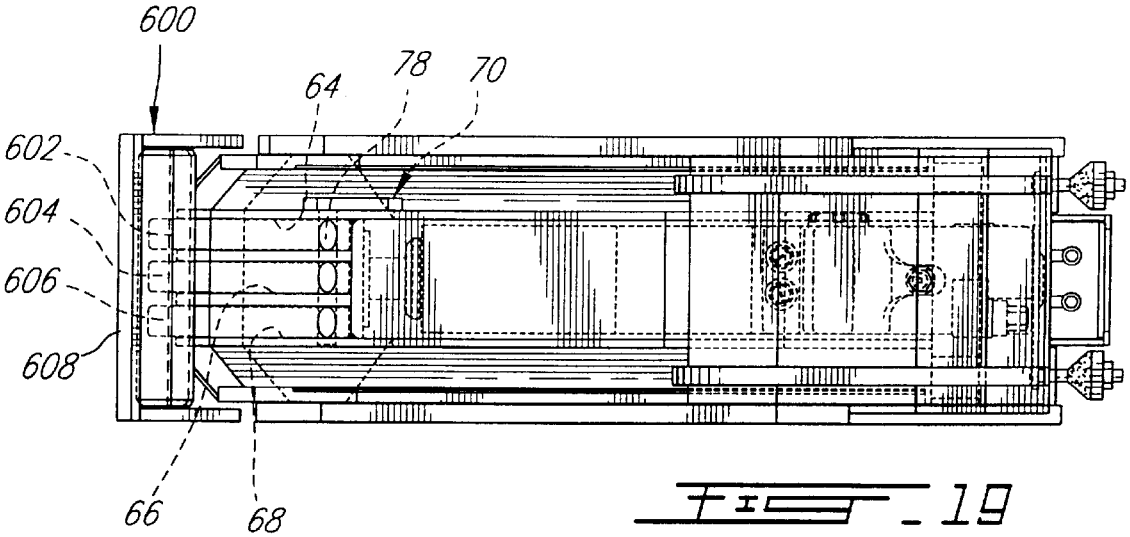
FIG. 19 is a top plan view of the excavating bucket of FIG. 18.

Finally, FIGS. 18 and 19 illustrate a compaction attachment 600 including three mounting rods 602, 604 and 606 configured sized and positioned to enter the three tool receiving apertures 64, 66 and 68 of the tool holding assembly 62. Again, each mounting rod is provided with a tangential channel 78 enabling the rods to be locked in position by the tool locking mechanism 70. The compaction attachment 600 includes a flat compaction head 608 that may be pivoted about a pivot attachment 610.

Another advantage of the movable floor 24 is the possibility to disengage soil that has been packed in the bucket body 22. Indeed, instead of repetitively moving the bucket body 22 up and down to dislodge the packet soil from inside the bucket body, the user may energize the impact actuator assembly 26 to both move the movable floor 24 and vibrate the entire excavation bucket 20 to dislodge the soil.

It is to be noted that the energization of the impact actuator assembly 26 could be done automatically when the leading edge 42 of the movable floor 24 contacts a hard surface. For example, the wedging element 132 could be replaced by a compressible element (not shown) and a pressure sensor (not shown) could be associated with this compressible element to detect its compression caused by the movements of the impact actuator assembly 26. The output of this sensor would be used to selectively energize the impact actuator assembly 26 when the pressure detected is above a predetermined level. Another way of achieving the same result would be to provide a displacement sensor (not shown) detecting the displacement of the movable floor 24 with respect to the bucket body 22. Again, the output of this sensor would be used to selectively energize the impact actuator assembly 26 when the displacement detected is above a predetermined level.

It is also to be noted that the replaceable impact receiving plate 84 is provided to prevent premature wear of the movable floor 24 and may be replaced if deteriorated by the repetitive impacts of the impact head 122.

Although the present invention has been described hereinabove by way of preferred embodiments thereof, it can be modified, without departing from the spirit and nature of the subject invention as defined in the appended claims.

What is claimed is:

1. An excavation bucket comprising:

a bucket body including a floor portion having a longitudinal axis and lateral side portions, said longitudinal axis extending substantially parallel to said lateral side portions;

a movable floor so mounted to said bucket body as to (a) be longitudinally slidable between a retracted position and an extended position, (b) provide a free space between said floor portion and said movable floor and (c) form a scoop cavity with said lateral side portions;

means for selectively sliding said movable floor between said retracted and extended positions; said sliding means being mounted in said free space.

2. The excavation bucket as recited in claim 1, wherein said sliding means is fixedly mounted to said bucket body and associated with said movable floor.

3. The excavation bucket as recited in claim 1, wherein said sliding means includes an impact actuator.

4. The excavation bucket as recited in claim 3, wherein said impact actuator includes:

a longitudinal actuator body fixedly mounted to said bucket body; said actuator body being generally tubular and provided with an open end;

an impact head having a proximate end slidably mounted to said open end of said tubular body and a distal end contacting said movable floor;

a hammer slidably mounted in said tubular actuator body for reciprocal longitudinal movements between impact position where it contacts said proximate end of said impact head and non impact position;

wherein said contact between said hammer and said proximate end of said impact head when said hammer is moved from said non impact position to said impact position cause said impact head to be forcefully and longitudinally moved towards said movable floor to thereby cause the movable floor to be longitudinally and outwardly moved from its retracted position towards its extended position.

5. The excavation bucket as recited in claim 1, wherein said movable floor includes means for preventing said extended position to be exceeded.

6. The excavation bucket as recited in claim 5, wherein said preventing means including means for securing said movable floor to said bucket body while allowing said movable floor to slide between said retracted and extended positions.

7. The excavation bucket as recited in claim 6, wherein said bucket body includes a rear portion said securing means being provided between said movable floor and said rear portion of said bucket body.

8. The excavation bucket as recited in claim 7, wherein said securing means include (a) at least one fastener connected to said movable floor and going through an aperture of said rear portion of said bucket body; a rigid plate traversed by said fastener so that said rear portion of said bucket body is positioned between said movable floor and said rigid plate.

9. The excavation bucket as recited in claim 8, wherein said preventing means further include a resilient layer provided between said rigid plate and said rear portion of said bucket body, wherein said at least one fastener, said rigid plate and resilient layer prevent said extended position to be exceeded.

10. The excavation bucket as recited in claim 1, wherein said movable floor includes a leading edge portion provided with a tool holding assembly.

11. The excavation bucket as recited in claim 10, wherein said tool holding assembly includes at least one tool receiving longitudinal aperture and one tool locking mechanism allowing tools inserted in said at least one tool receiving aperture to be releasably maintained therein.

12. The excavation bucket as recited in claim 11, wherein said tool holding assembly includes three tool receiving longitudinal apertures.

13. The excavation bucket as recited in claim 12, wherein said tool locking mechanism includes a handle and a cylindrical pivot bar fixedly mounted to said handle; said pivot bar being laterally mounted to said tool holding assembly for pivotable movements between a non locking position and a locking position; said pivot bar including a longitudinal channel facing tangential channels of the tools inserted in the receiving apertures when said pivot bar is in said non locking position.

14. The excavation bucket as recited in claim 12, further comprising three teeth releasably mounted to a respective tool receiving aperture.

15. The excavation bucket as recited in claim 11, further comprising a clay cutting attachment releasably inserted in said at least one tool receiving aperture.

16. The excavation bucket as recited in claim 11, further comprising a root shredding attachment releasably inserted in said at least one tool receiving aperture.

17. The excavation bucket as recited in claim 11, further comprising a picket ramming attachment releasably inserted in said at least one tool receiving aperture.

18. The excavation bucket as recited in claim 11, further comprising a compaction attachment releasably inserted in said at least one tool receiving aperture.

19. The excavation bucket as recited in claim 10, wherein said leading edge portion has a generally tapering cross-section.

20. The excavation bucket as recited in claim 1, further comprising sealing means provided between said movable floor and said bucket body generally preventing dirt from entering said free space.

21. The excavation bucket as recited in claim 1, wherein said lateral side portions of said bucket body includes internal lateral guides allowing longitudinal movements of said movable floor and preventing other movements of said movable floor.

* * * * *